US005531313A

United States Patent [19]

Maass

[11] Patent Number: 5,531,313

[45] Date of Patent: Jul. 2, 1996

[54] DEVICE FOR CONVEYING A CONTINUOUS SHINGLED SHEET STREAM

[75] Inventor: Burkhard Maass, Heidelberg, Germany

[73] Assignee: Heidelberger Druckmaschinen AG, Heidelberg, Germany

[21] Appl. No.: 437,288

[22] Filed: May 8, 1995

[30] Foreign Application Priority Data

May 7, 1994 [DE] Germany ..... 44 16 289.8

[51] Int. Cl.[6] ..... B65G 17/46

[52] U.S. Cl. ..... 198/689.1; 271/197

[58] Field of Search ..... 198/689.1; 271/197, 271/276

[56] References Cited

U.S. PATENT DOCUMENTS

| | | | |
|---|---|---|---|
| 3,202,302 | 8/1965 | Insolio | 198/689.1 X |
| 3,712,455 | 1/1973 | Anfossi et al. | 198/689.1 X |
| 3,827,548 | 8/1974 | Matsuo | 198/689.1 |
| 4,447,817 | 5/1984 | Naramore | 271/197 X |
| 4,719,721 | 1/1988 | Stump | 198/689.1 X |
| 4,819,928 | 4/1989 | Osborn et al. | 271/276 |
| 4,997,178 | 3/1991 | Ogoda | 271/276 |
| 5,114,307 | 5/1992 | Meli et al. | 198/689.1 X |

FOREIGN PATENT DOCUMENTS

| | | |
|---|---|---|
| 1244810 | 7/1967 | Germany . |
| 31 31 687 | 3/1983 | Germany . |
| 85 31 900.7 | 5/1986 | Germany . |
| 42 03 511 | 8/1993 | Germany . |

*Primary Examiner*—James R. Bidwell
*Attorney, Agent, or Firm*—Herbert L. Lerner; Laurence A. Greenberg

[57] ABSTRACT

Device for conveying a continuous shingled or overlapping sheet or copy stream to a rotary printing press, with a conveying table, at least one endless, revolvingly drivable conveyor belt surrounding the conveying table, and at least one suction box disposed beneath the conveying table and being connected through suction openings with the underside of the conveyor belt, the conveyor belt being formed with through-perforated suction holes, the suction box being formed with at least two suction chambers subjectible to negative pressure or vacuum independently of one another, includes a base member forming a suction box, profiled guide sections accommodated in the base member, suction ducts formed between edges of the profiled guide sections and boundaries of the base member, the edges forming a seal, and the suction ducts extending in different planes in the base member.

8 Claims, 2 Drawing Sheets

DEVICE FOR CONVEYING A CONTINUOUS SHINGLED SHEET STREAM

BACKGROUND OF THE INVENTION

1. Field of the Invention

The invention relates to a device for conveying a continuous shingled or overlapping sheet or copy stream to a rotary printing press, with a conveying table, at least one endless, revolvingly drivable conveyor belt surrounding the conveying table, and at least one suction box disposed underneath the conveying table and being connected through suction openings with the underside of the conveyor belt, the conveyor belt being formed with through-perforated suction holes, the suction box being formed with at least two suction chambers subjectible to negative pressure or vacuum independently of one another.

The published German Patent Document DE 42 03 511 A1 has already disclosed a device for conveying a continuous shingled sheet stream to a sheet-processing machine. One vacuum chamber is permanently subjected to vacuum from a vacuum or negative pressure source, while a further vacuum or negative pressure box in front of the front lays is convertible or changeable over from vacuum or negative pressure action to overpressure action. The further vacuum box is associated both with a vacuum or negative pressure source and also with an overpressure source, while the vacuum box is connected only to a vacuum or negative pressure source. The changeover from suction air to blast air in the further suction box is accomplished under the control of a sensor system which, coupled to a delay unit, initiates a jolt of blast air in the further suction box in front of the front lays. A disadvantage of this heretofore known device is, on the one hand, the condition that it is necessary to provide an overpressure source and, on the other hand, that a jolt or blast of air in the alignment region may result in the occurrence of inaccuracies in the feeding of the sheets.

2. Summary of the Invention

Proceeding from the aforedescribed state of the prior art, it is accordingly an object of the invention to provide a device for conveying a continuous shingled sheet stream and, more particularly, to such a device in which a suction module is realized by using extremely simple means.

With the foregoing and other objects in view, there is provided, in accordance with the invention, a device for conveying a continuous shingled or overlapping sheet or copy stream to a rotary printing press, with a conveying table, at least one endless, revolvingly drivable conveyor belt surrounding the conveying table, and at least one suction box disposed beneath the conveying table and being connected through suction openings with the underside of the conveyor belt, the conveyor belt being formed with through-perforated suction holes, the suction box being formed with at least two suction chambers subjectible to negative pressure or vacuum independently of one another, comprising a base member forming a suction box, profiled guide sections accommodated in the base member, suction ducts formed between edges of the profiled guide sections and boundaries of the base member, the edges forming a seal, and the suction ducts extending in different planes in the base member.

In accordance with another feature of the invention, the first and the second profiled guide sections are disposed above one another in the base member.

In accordance with a further feature of the invention, the sheet or copy stream is conveyable in a transport plane, the base member being connected, on a side thereof facing away from the transport plane, to a suction plate.

In accordance with an added feature of the invention, the suction plate has sealing strips.

In accordance with an additional feature of the invention, the first and the second profiled guide sections are U-shaped.

In accordance with yet another feature of the invention, the first and the second profiled guide sections have bent-away ends engaging beneath a side of the conveyor belt.

In accordance with yet a further feature of the invention, the device includes a suction plate having sealing lips, the bent-away ends of the first and the second profiled guide sections are in contact with the sealing strips of said suction plate.

In accordance with a concomitant feature of the invention, the suction ducts in the base member extend in at least two parallel planes.

By employing the profiled guide sections embedded in the base member, for the sealing of the suction ducts, it is possible for suction air to be routed in a plurality of planes in the base member. Assurance is thereby provided that an effective vacuum, which is not diminished by leaks, is in the suction chambers more remote from the suction-air source; moreover, a flat surface is formed on the underside of the base member, which permits a relatively simple assembly.

A first profiled guide section and a second profiled guide section are fixed in location in the base member. The first profiled guide section and the second profiled guide section are provided on top of one another in the base member. The base member is connected, on a side thereof facing away from a material-transport plane, to a suction plate, wherein sealing strips are embedded. The sealing strips are formed of a sealing material, such as sponge rubber, for example, which is capable of compensating for large sealing-gap tolerances. The bent metal parts can thereby be formed with economically manufacturable tolerances. Because the first profiled guide section and the second profiled guide section are U-shaped and also have bent-away end regions, it is possible, during assembly or installation of the suction plate, to achieve a sealing of the suction ducts, which are respectively bounded by the profiled guide sections.

With the suction plate installed, the bent-away end regions are pressed against the sealing strips of the suction plate in such a manner that the outer portions of the bent-away end regions constitute a boundary of the suction duct, and the inner edges engage beneath the conveyor belt. The construction of the first and second profiled guide sections makes it possible for two suction ducts, independently of one another and sealed with respect to one another, to be provided in one base member.

Other features which are considered as characteristic for the invention are set forth in the appended claims.

Although the invention is illustrated and described herein as embodied in a device for conveying a continuous shingled sheet stream, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
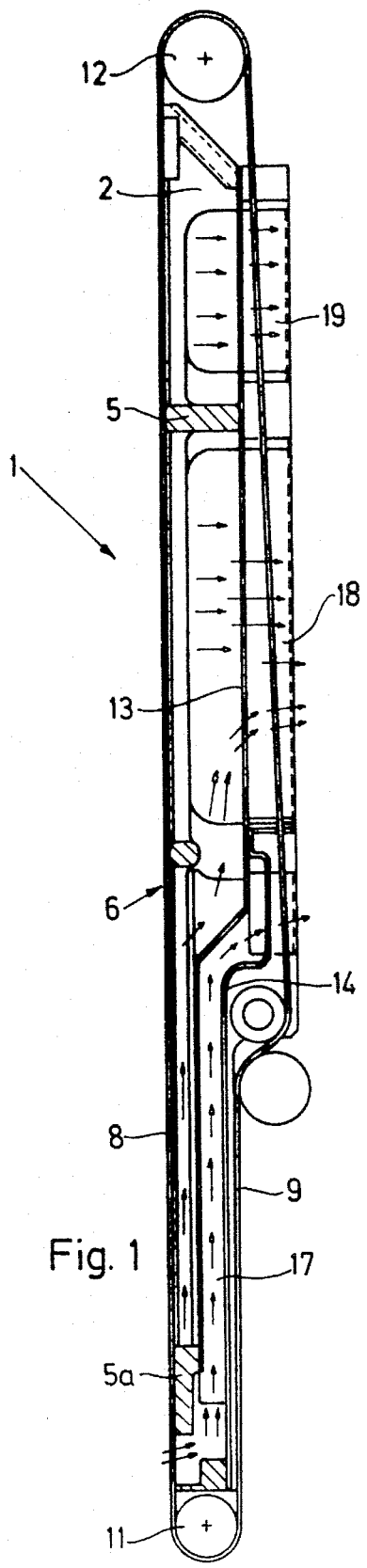
FIG. 1 is a vertical sectional view in longitudinal direction of a suction module according to the invention.

Referring now to the drawings and, first, particularly to FIG. 1 thereof, there is shown therein a suction module 1 according to the invention, which is formed essentially of a base member 2. The base member 2 accommodates both a guide roller 11 and also a drive roller 12, and a conveyor belt 6 revolving on the rollers 11 and 12. The no-load side 9 of the conveyor belt 6 is guided along on the underside of the base member 2, while the load side 8 is guided on the upper side of the base member 2, and fixedly holds a conveyed material by the action of suction air passing through openings formed in the belt 6.

Provided in the base member 2 are suction ducts 17, 18 and 19, which supply suction air to a plurality of suction chambers in accordance with the arrows shown in FIG. 1. Two of the suction chambers and the suction channels or ducts 18 and 19, respectively, are divided by a cross-piece or web 5; the suction duct 17 extending underneath a first profiled guide section 13 and being bounded by a second profiled guide section 14. The suction duct 17 extends under a suction chamber located next to the guide roller 11, the suction chamber being subjected to vacuum by the suction duct 17. The suction duct 17 terminates in a lower part of the base member 2. The suction duct 18 extends into the suction chamber next to the guide roller 11, due to the shape of the first profiled guide section 13, and applies vacuum to the region extending from an embedded cross-piece 5*a* to the cross-piece 5. Furthermore, vacuum is supplied to that part of the middle suction chamber which is directly above the suction duct 18.

The suction chamber extending from the cross-piece 5 to the belt or tape drive roller 12 is directly connected to the suction duct 19 and is subjected to vacuum through the latter.

Figure 2:
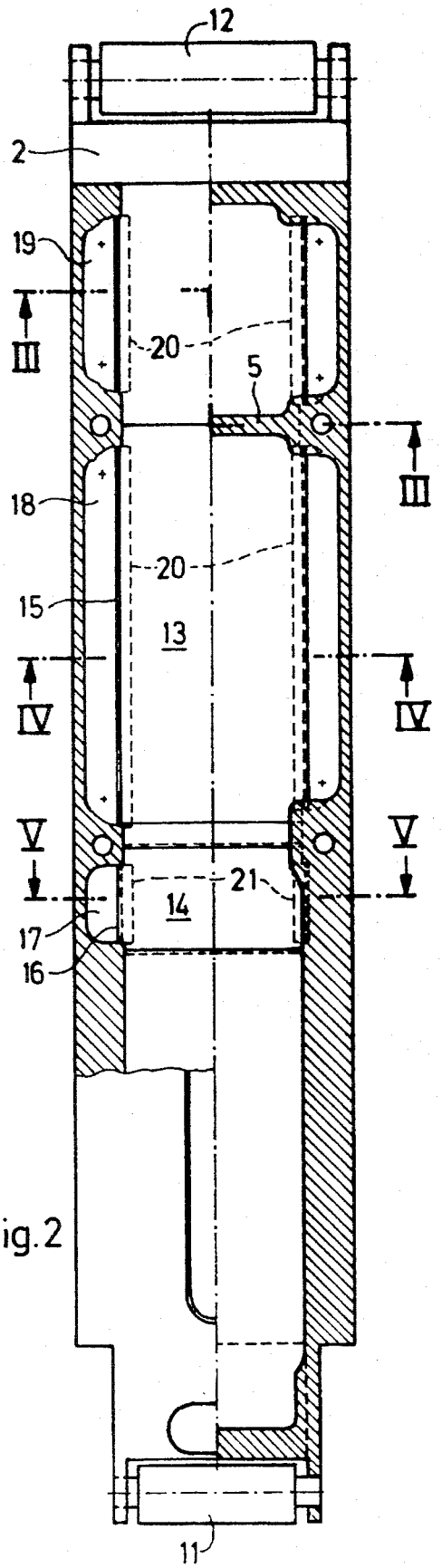
FIG. 2 is a top plan view, partly in section and partly broken-away, of FIG. 1, showing a base member of the suction module, with the surrounding belt of the conveyor omitted.
Figure 3:
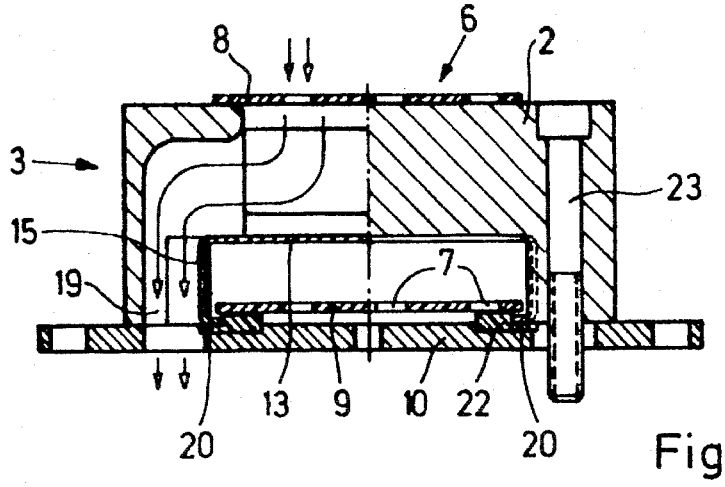
FIG. 3 is a cross-sectional view of FIG. 2 taken along the line III—III in the direction of the arrows.
Figure 4:
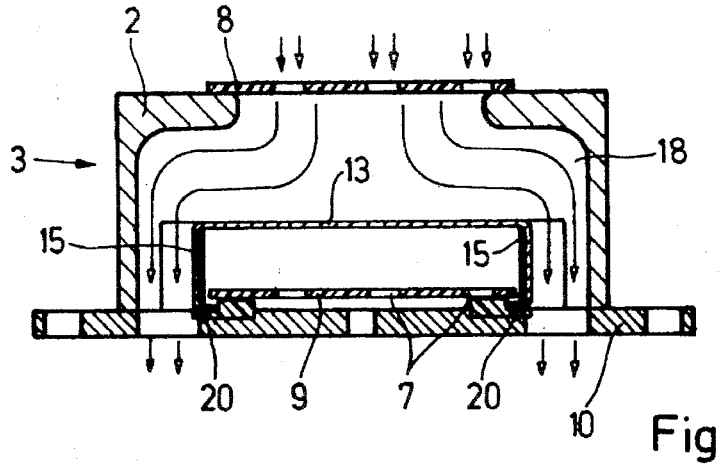
FIG. 4 is a cross-sectional view of FIG. 2 taken along the line IV—IV in the direction of the arrows.
Figure 5:
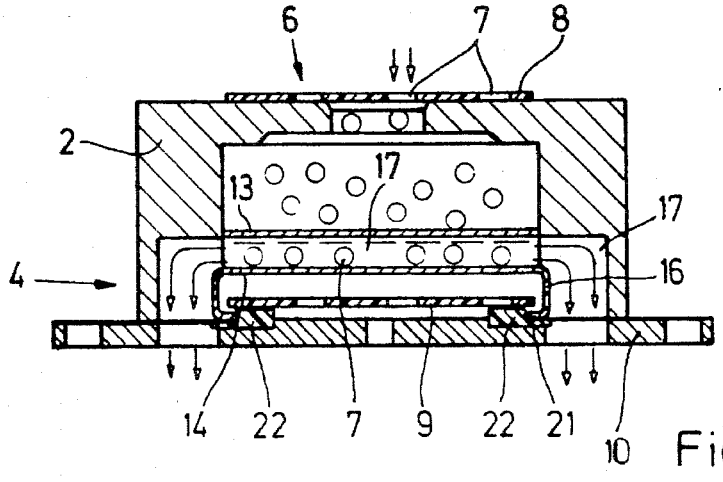
FIG. 5 is a cross-sectional view of FIG. 2 taken along the line V—V in the direction of the arrows.

The top plan view of the partly broken-away base member 2 in FIG. 2 shows that the suction ducts 17, 18 and 19, respectively, extend laterally with respect to the first and second profile guide sections 13 and 14, bounded by edges 15 and 16 of the guide sections 13 and 14 and recesses formed in the base member 2. FIGS. 3, 4 and 5, showing sections taken along the lines III—III, IV—IV and V—V in FIG. 2, illustrate that the suction ducts 17 and 19 extend in different planes 3 and 4 inside the base member 2.

FIG. 3 is a cross-sectional view in offset planes along the line III—III in FIG. 2.

The load side 8 of the conveyor or transport belt 6 extends above the base member 2; the no-load side 9 of the transport or conveyor belt 6 is accommodated in the base member 2. The no-load side 9 is enclosed in the base member 2 by the first guide section 13, bent-away ends 20 of which resting on sealing strips 22 of a suction plate 10. The no-load side 9 is sunk into the base member 2, so that the base member 2 can be bolted in a relatively simple manner to a flat plate. Consequently, the suction air, as shown by the arrows in FIG. 3 flows off into the suction duct 19, which is bounded by the base member 2 and by the edges 15 of the first profiled guide section 13. Due to the configuration of the box-type first profiled guide section 13, the upper region of the suction duct 19 lies in an upper plane 3 of the base member 2. The base member 2 is attachable to the flange of a vacuum or negative pressure source by means of a bolt 23, which penetrates the base member 2 and the suction plate 10.

The sectional view in FIG. 4 taken along the line IV—IV in FIG. 2 illustrates that the suction duct 18 extends likewise in the upper plane 3 of the base member 2 and that the suction air flows past the edges 15 of the first profiled guide section 13. It becomes apparent from this representation that, in the region of the suction duct 18, the load side 8 of the transport belt 6 is likewise encapsulated. The bent-away end regions 20, engaging beneath the load side 8 on the outside, are in contact with the upper side of the sealing strips 22.

The representation in FIG. 5 is a cross-sectional view of the suction duct 17, which supplies vacuum to the suction chamber adjoining the guide roller 11. As is apparent from FIG. 5 and FIG. 1, the suction duct 17 is bounded by the two profiled guide sections 13 and 14, and lies in a lower plane 4 of the base member 2. The load side 8 is enclosed by the bent-away end regions 21 of the second profiled guide section 14. The bent-away ends 21 rest on the sealing strips 22. Consequently, the suction duct 17 extends underneath the first profiled guide section 13, which is embedded in the base member 2, and consequently it is possible for vacuum to be effectively supplied to the suction chamber which is situated directly next to the guide roller 11. In this case, the second profiled guide section 14 is responsible for the encapsulating function of the load side 9 of the conveyor or transport belt 6, so that a suction duct 17 which is closed off with respect to the environment and permits the flat construction of the suction module 1 is formed.

A suction line is created inside the base member 2 by the combination of the two profiled guide sections 13 and 14. There is no need whatsoever for additional tubing or for the use of fittings. There are no difficulties during assembly, because the problems usually caused by the routing of tubing are eliminated.

I claim:

1. Device for conveying a continuous shingled or overlapping sheet or copy stream to a rotary printing press, with a conveying table, at least one endless, revolvingly drivable conveyor belt surrounding the conveying table, and at least one suction box disposed beneath the conveying table and being connected through suction openings with the underside of the conveyor belt, the conveyor belt being formed with through-perforated suction holes, the suction box being formed with at least two suction chambers subjectible to negative pressure or vacuum independently of one another, comprising a base member forming a suction box, profiled guide sections accommodated in said base member, suction ducts formed between edges of said profiled guide sections and boundaries of said base member, said edges forming a seal, and said suction ducts extending in different planes in said base member.

2. Device according to claim 1, wherein said first and said second profiled guide sections are disposed above one another in said base member.

3. Device according to claim 1, wherein the sheet or copy stream is conveyable in a transport plane, said base member being connected, on a side thereof facing away from said transport plane, to a suction plate.

4. Device according to claim 3, wherein said suction plate has sealing strips.

5. Device according to claim 1, wherein said first and said second profiled guide sections are U-shaped.

6. Device according to claim 1, wherein said first and said second profiled guide sections have bent-away ends engaging beneath a side of the conveyor belt.

7. Device according to claim 6, including a suction plate having sealing lips, said bent-away ends of said first and said second profiled guide sections are in contact with said sealing strips of said suction plate.

8. Device according to claim 1, wherein said suction ducts in said base member extend in at least two parallel planes.

* * * * *